United States Patent [19]

Kunitomi et al.

[11] Patent Number: 4,968,161

[45] Date of Patent: Nov. 6, 1990

[54] RIBBON CASSETTE FOR REINKING ONLY ONE LONGITUDINAL HALF OF A MÖBIUS RIBBON

[75] Inventors: Yoshio Kunitomi, Tanashi; Kazui Nagata, Hirakata, both of Japan

[73] Assignees: Citizen Watch Co., Ltd., Tokyo; Union Chemical Co., Ltd., Osaka, both of Japan

[21] Appl. No.: 384,447

[22] Filed: Jul. 25, 1989

[30] Foreign Application Priority Data

Jul. 27, 1988 [JP] Japan ..... 63-100527[U]

[51] Int. Cl.[5] ..... B41J 32/02; B41J 33/10

[52] U.S. Cl. ..... 400/195; 400/197; 400/196.1; 400/208

[58] Field of Search ..... 400/194, 195, 196, 196.1, 400/197, 198, 199, 200, 201, 202, 202.1, 202.2, 202.3, 202.4, 207, 208, 208.1

[56] References Cited

U.S. PATENT DOCUMENTS 3,951,253 4/1976 Tibay et al. ..... 400/201

FOREIGN PATENT DOCUMENTS 8501017 3/1985 Int'l Pat. Institute ..... 400/202.4
0040288 3/1985 Japan ..... 400/202.4
0132660 6/1987 Japan ..... 400/198

*Primary Examiner*—Edgar S. Burr
*Assistant Examiner*—Joseph R. Keating
*Attorney, Agent, or Firm*—Birch, Stewart, Kolasch & Birch

[57] ABSTRACT

An endless inked ribbhon provided in a case is twisted in the form of a Möbius band. An inverting device is provided in the case for inverting the inked ribbon, and a reinking device is provided adjacent the inverting device for supplying ink to a lower half portion of the ribbon. The upper half portion of the ribbon, which has been supplied with the ink during the preceding cycle of the operation of the ribbon, is used for printing dots on paper.

3 Claims, 2 Drawing Sheets

RIBBON CASSETTE FOR REINKING ONLY ONE LONGITUDINAL HALF OF A MöBIUS RIBBON

BACKGROUND OF THE INVENTION

The present invention relates to a ribbon cassette for a dot matrix impact printer, and more particularly to a ribbon cassette in which an endless inked ribbon is reinked during the printing operation.

A conventional reinking system for an impact printer is adapted to supply ink to a whole surface of the ribbon. Further, the ink is supplied to the ribbon after the printed thickness image has become light in order to extend the printing period without reinking. Further, the reinked ribbon is subjected to printing before a sufficient time elapses to saturate uniformly the ribbon with ink. In addition, when the ink is supplied to the ribbon, the fiber of the ribbon is somewhat damaged. Consequently, the ribbon does not sufficiently absorb the ink so that the ink merely attaches to the surface of the ribbon. Thus, printed letters become irregular and indefinite, which causes reduction of printing quality.

SUMMARY OF THE INVENTION

The object of the present invention is to provide a ribbon cassette in which the ribbon may be uniformly saturated at ink, so that the printing is performed with a high quality for a long time.

According to the present invention, there is provided a ribbon cassette for an impact printer having a case with an outlet and inlet, an endless inked ribbon provided in the case, a part of the inked ribbon being outside the case for performing printing, and driving rollers for moving the inked ribbon through the case from the inside of the outside of the case. The ribbon cassette require that the inked ribbon being twisted in the form of a Möbius band, an inverting device provided inthe case near the outlet for inverting the inked ribbon, and a reinking device provided adjacent the inverting device for supplying ink to a lateral half portion of the ribbon which is next subjected to a printing impact after one-cycle of operation.

In an aspect of the invention, the reinking device comprises an ink fountain roller, an ink impregnated roller provided coaxially with the ink fountain roller at the underside of the ink fountain roller, and an ink distributing roller engaged with the ink impregnated roller and a lower half portion of the ribbon. The ink fountain roller has a larger porosity than the ink impregnated roller.

These and other objects and features of the present invention will become more apparent from the following detailed description with reference to the accompanying drawings.

DETAILED DESCRIPTION OF THE INVENTION

Figure 1:
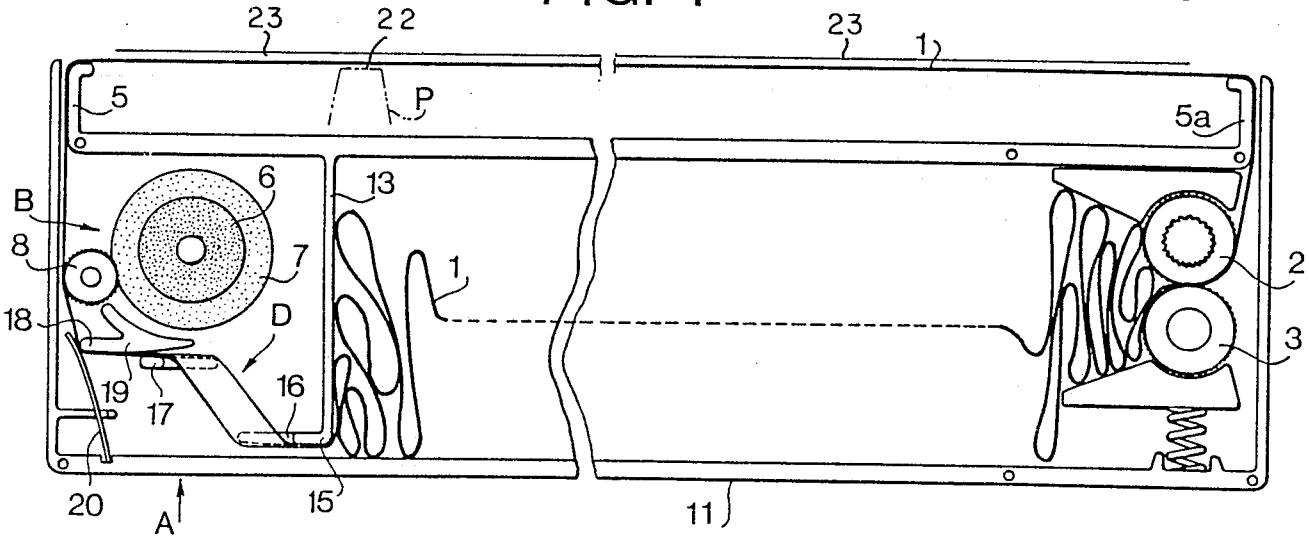
FIG. 1 is a plan view showing the interior of a ribbon cassette of the present invention.

Referring to FIG. 1, a ribbon cassette of the present invention comprises a case 11 having an outwardly projected inlet 5*a* and an outwardly projected outlet 5 opposed to each other, and a pair of driving rollers 2 and 3 provided in the case 11 adjacent to the inlet 5*a* for feeding an endless inked ribbon 1 into the cassette. The inked ribbon 1 is twisted in the form of a Möbius band. A greater part of the inked ribbon 1 is enclosed in the case 11. A guide plate 13 is provided near the outlet 5. The ribbon cassette further has a ribbon inverting device D near the outlet 5 for inverting the inked ribbon 1 and a reinking device B for supplying ink to the depleted inked ribbon 1. The endless inked ribbon 1 is drawn out from the case 11 and fed to the outlet 5 passing through the ribbon inverting device D and the reinking device B. A part of the inked ribbon 1 is exposed between the outlet 5 and the inlet 5*a* and drawn back into the case 11 by the driving rollers 2 and 3.

Figure 4:
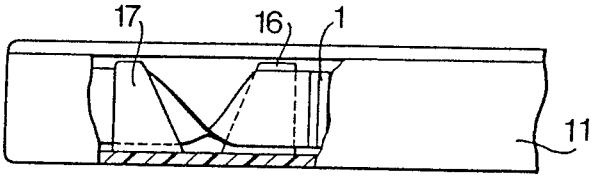
FIG. 4 is a side view as seen from an arrow A in FIG. 1.

As shown in FIGS. 1 and 4, the ribbon inverting device D comprises a first vertical guide corner 15 formed on the guide plate 13, a first slant 16 inclined in a first direction, a second slant 17 inclined in a second direction making an angle of about 90° with the first direction, and a second vertical corner 18 formed on a guide member 19. A spring plate 20 is provided to press the ribbon 1 to the second vertical corner 18.

Figure 2:
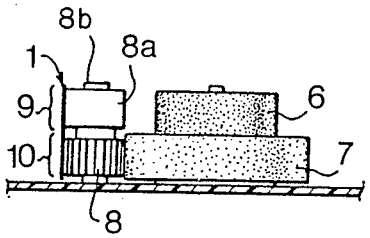
FIG. 2 is an enlarged side view showing a reinking device of the ribbon cassette.

Referring to FIG. 2, the reinking device B comprises an ink fountain roller 6, an ink impregnated roller 7 coaxially provided on the underside of the ink fountain roller 6, an ink distributing roller 8 having a knurling surface and engaged with the ink impregnated roller 7, and a guide roller 8*a*. The width of the roller 8 is one-half of the width of the inked ribbon 1 so that the inked ribbon 1 is engaged with the ink distributing roller 8 at a lower half portion of the ribbon 1. The guide roller 8*a* is mounted on a shaft 8*b* of the roller 8 to support an upper portion 9 of the ribbon 1. The rollers 6 and 7 are made of porous material such as felt, sponge and the like. The ink impregnated roller 7 has a smaller porosity compared with the ink fountain roller 6 for enabling the controlling of the ink distribution to the ink distributing roller 8. The ink kept in the ink fountain roller 6 is applied to the ink impregnated roller 7 and further to the ink distributing roller 8. Thus, the ink is supplied to the lower hald 10 of the ribbon 1.

Figure 3:
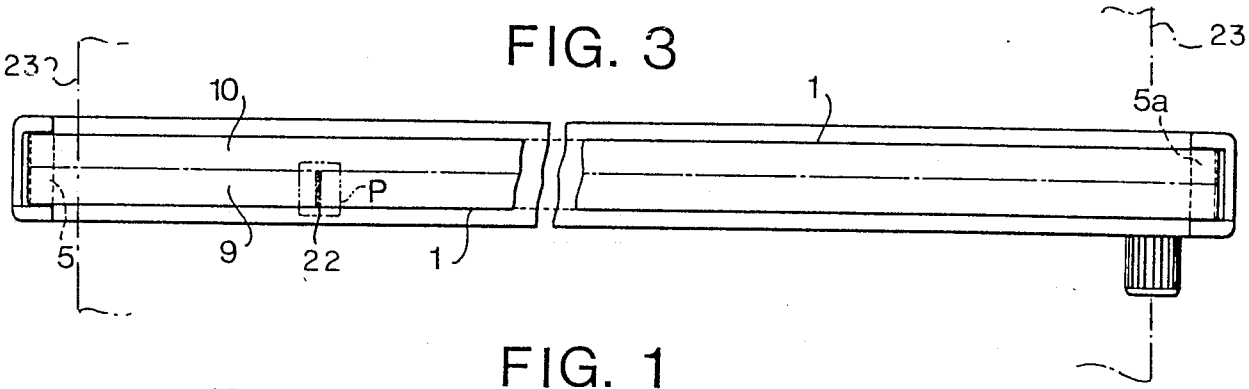
FIG. 3 is a front view of the ribbon cassette.

FIG. 3 shows the inked ribbon 1 at the front of the ribbon cassette. As described above, an upper half portion 9 of the inked ribbon 1 is not reinked, but a lower half portion 10 of the ribbon 1 is reinked. In the present invention, the ribbon cassette is attached to a printer such that styluses of a print head P of the printer strike the upper half portion 9 of the inked tibbon 1 to print dots on a recording power 23.

In operation, the ribbon 1 passes the first vertical guide corner 15 in the vertical position. Between of the first slant 16 and the second slant 17, the ribbon 1 is twisted and inverted. The ribbon 1 is guided by the spring plate 20 and the second vertical corner 18. At the reinking device B, the lower half portion 10 of the ribbon 1 is supplied with ink from the ink distributing roller 8. During printing, styluses 22 of the print head P strike the upper half portion 9 to print dots on the recording paper 23. When the struck portion of the ribbon 1 returns to the ribbon inverting device D, after one-cycle of operation of the ribbon 1 and passes through the device D, the struck upper half portion 9 changes to the lower half portion and the reinked lower half portion 10 changes to the upper half portion, because of the characteristic of the Möbius band. Thus, the struck portion of the ribbon 1 is supplied with ink and the reinked portion passes through one-cycle operation before it is subjected to the printing step.

Figure 5:
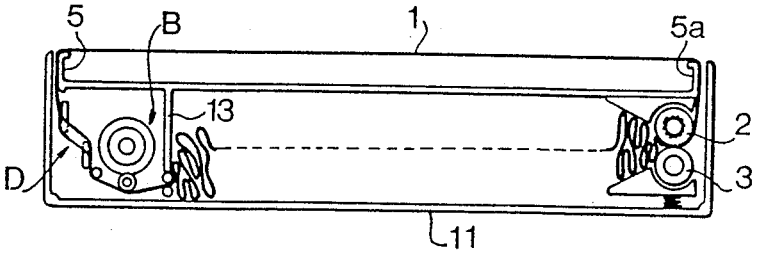
FIG. 5 is a plan view showing another embodiment of the present invention.

Referring to FIG. 5 showing another embodiment of the present invention, the ribbon inverting device D is located after the reinking device B and styluses 22 of the print head P of the printer are provided to strike the lower half portion 10 of the inked ribbon 1. The inked ribbon 1 drawn from the case 11 passing through the guide plate 13 is supplied with the ink from the reinking device B at the lower half portion 10 thereof and twisted by the ribbon inverting device D to be inverted. Thus, the lower half portion 10 which is supplied with ink during a first cycle is used for printing dots on paper.

In accordance with the present invention, the inked ribbon is twisted in the form of a Möbius band and is supplied with ink on half of the width of the ribbon. The printing is performed at the half portion which has been reinked during the last or previous cycle of the operation. Since the reinked portion of the inked ribbon is not subjected to printing during one-cycle, the ink becomes uniformly distributed in the ribbon during the cycle. Accordingly, a print having a fine and high quality image is provided for a long time and the life of the inked ribbon can be extended.

While the invention has been described in conjunction with preferred specific embodiments thereof, it will be understood that this description is intended to illustrate and not limit the scope of the invention, which is defined by the following claims.

What is claimed is:

1. A ribbon cassette for an impact printer including a case having an outlet and inlet, an endless inked ribbon provided in said case, a part of the inked ribbon being provided outside said case for printing on a recording page, driving rollers for moving said inked ribbon passing from an inside to an outside of said case, said inked ribbon being twisted in the form of a Möbius band;

an inverting device provided in said case near said outlet for inverting said inked ribbon; and a reinking device provided adjacent said inverting device for supplying ink to a lateral half portion of said inked ribbon which reinked portion is next subjected to a printing impact only after one-cycle of the printing operation.

2. The ribbon cassette according to claim 1, wherein said reinking device comprises an ink fountain roller, an ink impregnated roller provided coaxially with said ink fountain roller at the underside of said ink fountain roller, and an ink distributing roller engaged with said ink impregnated roller and a lower half portion of said inked ribbon.

3. The ribbon cassette according to claim 2, wherein said ink fountain roller has a larger porosity than said ink impregnated roller.

* * * * *